US008740263B2

(12) United States Patent
Singh et al.

(10) Patent No.: US 8,740,263 B2
(45) Date of Patent: Jun. 3, 2014

(54) LATCH ASSEMBLY

(75) Inventors: Hardev Singh, West Midlands (GB); Peter Coleman, Birmingham (GB); David Peatey, Birmingham (GB); Andrew Fairey, Birmingham (GB); John Gorton, Birmingham (GB); Michael Smith, Birmingham (GB); Patrice Cardine, Sully-sur-Loire (FR); Samuel Hall, Sheffield (GB); Paul Norman, Rutland (GB); David Pritchard, West Midlands (GB)

(73) Assignee: Inteva Products, LLC, Troy, MI (US)

( * ) Notice: Subject to any disclaimer, the term of this patent is extended or adjusted under 35 U.S.C. 154(b) by 0 days.

(21) Appl. No.: 13/112,547

(22) Filed: May 20, 2011

(65) Prior Publication Data

US 2012/0098279 A1 Apr. 26, 2012

(30) Foreign Application Priority Data

May 21, 2010 (GB) ..... 1008484.6
May 25, 2010 (DE) ..... 20 2010 007 179 U

(51) Int. Cl.
*E05C 3/06* (2006.01)
*E05C 3/16* (2006.01)

(52) U.S. Cl.
USPC ..... 292/200; 292/201; 292/216

(58) Field of Classification Search
USPC ..... 292/200, 195, DIG. 23, 201, 216
See application file for complete search history.

(56) References Cited

U.S. PATENT DOCUMENTS

| | | | | |
|---|---|---|---|---|
| 4,988,135 | A * | 1/1991 | Ottino | 292/201 |
| 5,236,234 | A * | 8/1993 | Norman | 292/201 |
| 5,348,357 | A * | 9/1994 | Konchan et al. | 292/216 |
| 6,053,543 | A * | 4/2000 | Arabia et al. | 292/201 |
| 6,332,634 | B1 * | 12/2001 | Fukumoto et al. | 292/201 |
| 6,428,058 | B1 * | 8/2002 | Graute | 292/216 |
| 6,511,106 | B2 * | 1/2003 | Perkins et al. | 292/216 |
| 7,264,283 | B2 * | 9/2007 | Stoof et al. | 292/216 |
| 7,500,700 | B2 * | 3/2009 | Kunst | 292/201 |
| 7,827,836 | B2 * | 11/2010 | Cetnar | 70/257 |
| 7,874,599 | B2 * | 1/2011 | Suzumura et al. | 292/216 |
| 7,946,634 | B2 * | 5/2011 | Bendel | 292/201 |
| 2006/0261601 | A1 * | 11/2006 | Shimizu et al. | 292/216 |
| 2007/0194577 | A1 * | 8/2007 | Margheritti | 292/216 |
| 2007/0257496 | A1 * | 11/2007 | Spurr et al. | 292/57 |
| 2008/0217928 | A1 * | 9/2008 | Spurr | 292/198 |
| 2008/0303291 | A1 * | 12/2008 | Spurr | 292/216 |
| 2009/0199605 | A1 * | 8/2009 | Spurr et al. | 70/266 |
| 2010/0072761 | A1 * | 3/2010 | Tomaszewski et al. | 292/201 |
| 2010/0078945 | A1 * | 4/2010 | Imatomi et al. | 292/216 |

(Continued)

*Primary Examiner* — Kristina R Fulton
*Assistant Examiner* — Faria Ahmad
(74) *Attorney, Agent, or Firm* — Cantor Colburn LLP

(57) ABSTRACT

A latch assembly is provided, the latch assembly having: a chassis, a latch bolt having a closed position and an open position, a pawl having an engaged position and a disengaged position, an eccentric arrangement defining an eccentric axis and a pawl axis remote from the eccentric axis, wherein when the pawl moves from the engaged position to the disengaged position the eccentric arrangement rotates about the eccentric axis to move the pawl axis from a first pawl axis position to a second pawl axis position, a retaining mechanism having a retaining position at which the pawl axis is held in the first pawl axis position and having a non-retaining position at which the pawl axis is allowed to move to the second pawl axis position, a release lever configured to move the retaining mechanism between the retaining position and the non-retaining position.

20 Claims, 18 Drawing Sheets

(56) References Cited

U.S. PATENT DOCUMENTS

| | | | | |
|---|---|---|---|---|
| 2010/0194121 | A1* | 8/2010 | Konomoto et al. | 292/216 |
| 2010/0194122 | A1* | 8/2010 | Akizuki et al. | 292/216 |
| 2010/0207400 | A1* | 8/2010 | Tomaszewski et al. | 292/196 |
| 2010/0207401 | A1* | 8/2010 | Taga | 292/216 |
| 2010/0244466 | A1* | 9/2010 | Tomaszewski | 292/201 |
| 2011/0006551 | A1* | 1/2011 | Konchan et al. | 292/216 |
| 2011/0204660 | A1* | 8/2011 | Cumbo et al. | 292/217 |
| 2011/0204690 | A1* | 8/2011 | Torkowski et al. | 297/354.12 |

* cited by examiner

LATCH ASSEMBLY

CROSS REFERENCE TO RELATED APPLICATIONS

This application claims priority under 35 U.S.C.§119 to the following patent applications UK Patent Application No. 1008484.6 filed May 21, 2010 and German Utility Model Application No. 202010007179.8 filed May 25, 2010, the contents each of which are incorporated herein by reference thereto.

BACKGROUND

The present invention relates to latch assemblies, in particular latch assemblies for use with car doors, such as drivers doors, front passenger doors, rear passenger doors. Latch assemblies can be used on any other type of vehicle such as lorries, vans, pickups etc.

Latch assemblies are known to releasably secure doors in a closed position. Operation of an inside door handle or an outside door handle releases the latch allowing the door to open. Subsequent closure of the door will automatically relatch the latch.

Conventional latches (typically mounted on a vehicle door) have a latch bolt, typically in the form of a rotating claw which can be held in a closed position thereby retaining a striker (typically mounted on a door aperture) so as to hold an associated door closed. The latch can also be held in a first safety position by engagement between the pawl and claw. This first safety position is not a fully closed position, rather the door is slightly open, or ajar, but nevertheless held in this ajar position by the latch, i.e. in spite of being in the ajar position, the door will not open.

Traditionally, the claw will have a closed abutment and a first safety abutment. When the pawl engages the closed abutment the door is in the fully closed position and when the pawl engages the first safety abutment the door is in the first safety position. Alternatively the pawl can be provided with two abutments, namely a closed abutment and a first safety abutment. Engagement between the closed abutment of the pawl and the claw will hold the door in the closed position and engagement between the first safety abutment of the pawl and the claw will hold the door in the first safety position.

The pawl is rotatable about a pawl axis into and out of engagement with the claw. Typically the axis about which the pawl rotates is a fixed axis.

The first safety position is provided as a safety measure. With the door fully closed and the vehicle is being driven, in the event that the pawl abutment is disengaged from the claw abutment, the door will open but only as far as the first safety position. The driver and/or other vehicle occupant will be alerted to the fact that the door is ajar and will take appropriate action. In particular, should the pawl become disengaged from the claw in the closed position, the door will not fly open and endanger vehicle occupants.

Car doors have "weather" seals typically around their periphery. These seals are made from elastomeric material and when the door is in the closed and in the first safety position the weather seals are compressed therefore ensuring rain and dirt does not enter the vehicle. As will be appreciated, with the weather seals in a compressed condition, they tend to force the door open and this force is resisted by the pawl and claw.

Under normal conditions when the latch is initially opened the weather seals will push the door open sufficiently far to disengage the striker from the claw. Thus, for a door hinged at its front edge with a latch on its rear edge and a striker mounted on the door aperture, the weather seals might spring the door open at its rear edge by 50 to 100 mm. Clearly, for a driver to enter the vehicle he or she must then fully open the door.

However, under certain circumstances the door seals will not push the door to a position where the striker is fully disengaged from the claw. Thus, consider the circumstances of a vehicle being parked in the evening following a rainstorm. The vehicle and parts of the weather seals will be wet from the rain. Over night the temperature drops, and in this example drops to below freezing whereupon the water around the weather seals freezes and also the weather seals themselves cool to below freezing. The following morning when the driver comes to open the door the weather seals will be adhered to the door by ice and frost. The driver will attempt to open the driver's door but the ice and frost will prevent this. Under certain circumstances the door may move slightly, for example the latch may move 1 mm in an opening direction relative to the striker. The door may then be left in this position and the driver may then attempt and succeed at entering the vehicle via another door. However, as far as the driver's door is concerned, because of the slight movement of the latch relative to the striker, the pawl will not be able to reengage with the closed abutment on the claw (in this example it is the claw that has a closed abutment and a first safety abutment). As the vehicle is driven, it will warm up and the ice and frost will melt. As this occurs, the weather seals will then push the door open, but only as far as the first safety position since the pawl will engage the first safety abutment on the claw and prevent further opening of the door. Thus, under these circumstances it is safe to operate a conventional latch.

Alternative latches also have rotatable pawls but the axis about which the pawl rotates is able to move. Such latches must be able to operate safely even when the door seals are frozen.

Thus, an object of the present invention is to provide an improved door latch.

SUMMARY OF THE INVENTION

In one embodiment, a latch assembly is provided herein, the latch assembly having: a chassis, a latch bolt, movably mounted on the chassis and having a closed position for retaining a striker and an open position for releasing the striker, a pawl having an engaged position at which the pawl is engaged with the latch bolt to hold the latch bolt in the closed position and a disengaged position at which the pawl is disengaged from the latch bolt thereby allowing the latch bolt to move to the open position, an eccentric arrangement defining an eccentric axis and a pawl axis remote from the eccentric axis, with the eccentric arrangement being rotatable about the eccentric axis and with the pawl being rotatable about the pawl axis, in which when the pawl moves from the engaged position to the disengaged position the eccentric arrangement rotates about the eccentric axis to move the pawl axis from a first pawl axis position to a second pawl axis position, a retaining mechanism having a retaining position at which the pawl axis is held in the first pawl axis position and having a non-retaining position at which the pawl axis is allowed to move to the second pawl axis position, a release lever operable to move the retaining mechanism from the retaining position to the non-retaining position when the release lever is moved from a rest position to a released position, in which movement of the release lever from the released position to the rest position causes the pawl axis to move from the second pawl axis position to the first pawl axis position.

BRIEF DESCRIPTION OF THE DRAWINGS

The invention will now be described by way of example only with reference to the accompanying drawings in which.

DETAILED DESCRIPTION OF EXEMPLARY EMBODIMENTS

Figure 1:
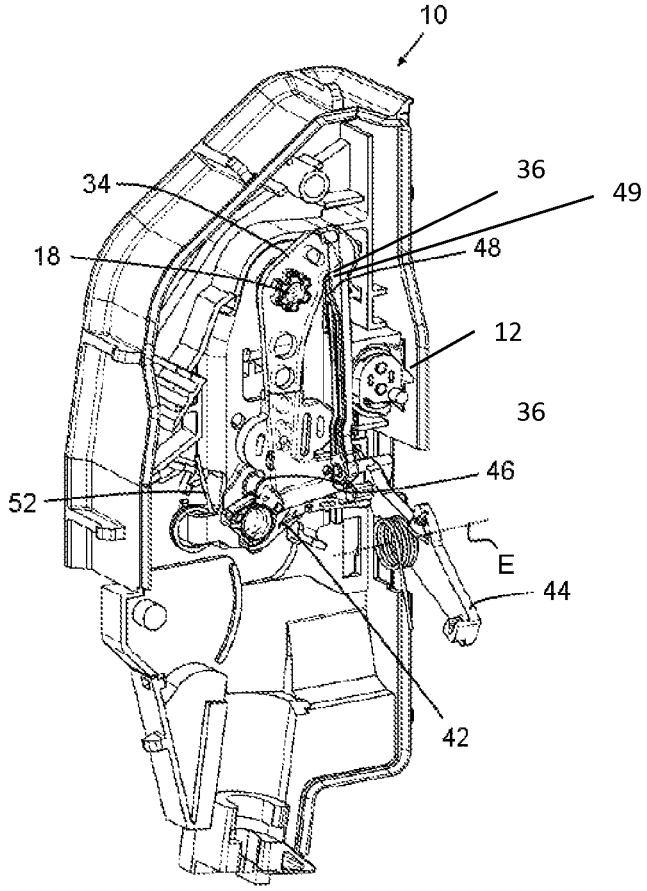
FIGS. 1 to 5 are isometric views of a latch assembly according to the present invention in various positions.
Figure 1A:
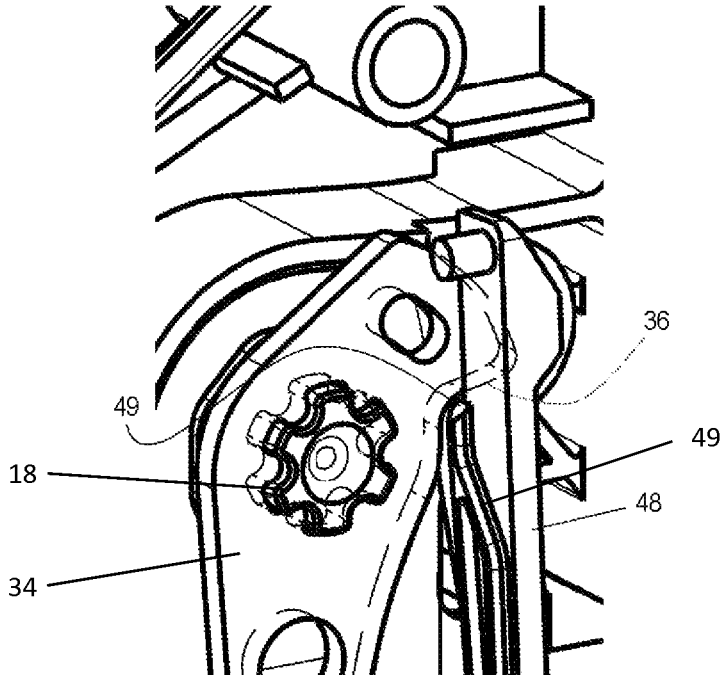
FIG. 1A is enlarged view of part of FIG. 1.

With reference to FIGS. 1 to 8 there is shown a latch, assembly 10 having a latch chassis 12, a latch bolt in the form of a rotating claw 14, a pawl 16, an eccentric arrangement in the form of a crank shaft 18.

The latch chassis 12 includes retention plate 22 and backplate 24. The rotating claw 14 is pivotably mounted on claw pivot pin 28. One end of claw pivot pin 28 is mounted in the retention plate and the other end of claw pivot pin 28 is mounted in the backplate. A crank shaft bush 30 is mounted on the backplate 24 and rotatably receives portion 18A of the crank shaft 18. End 18B of crank shaft 18 includes a lug 32 upon which the pawl 16 is rotatably mounted via hole 16A. The lug 32 in conjunction with hole 16A define a pawl pivot axis C parallel to but offset from the axis B about which crank shaft 18 rotates. The shape of hole 16 is generally oval with a bulge on one side and the shape of lug 32 is generally circular with a bulge on one side. These shapes help to reduce friction whilst maintaining sufficient strength in the lug. For a full explanation see International patent application PCT/GB2008/000328, the contents of which are hereby incorporated by reference.

A crank shaft lever 34 is non-rotatably fixed to one end of crank shaft 18. The crank shaft lever includes a reset abutment 36 which will be described further below. The crank shaft lever also defines a secondary pawl abutment 38.

Rotatably mounted via pin 40 secured to backplate 24 is secondary pawl 42.

A release lever 44 is pivotable about axis E. Release lever 44 includes a pin 46 upon which is mounted a reset link 48 which is engageable with reset abutment 36. Operation of the latch is similar in principle to operation of the latch as shown in International patent application PCT/GB2006/000586, the contents of which are hereby incorporated by reference. However, in summary:

With the latch in a closed position the pawl tooth 17 engages the closed abutment 50 of the rotating claw 14. The secondary pawl tooth 43 is engaged with the secondary pawl abutment 38 thereby ensuring the crank shaft 18 is in a first position. The release lever 44 is in a rest position. The reset link 48 is in a reset position, as shown in FIG. 1.

In order to release the latch, the release lever is rotated about release lever axis E to a released position whereupon an abutment on the release lever engages and moves the secondary pawl 42 rotatably about axis D so that the secondary pawl tooth 43 is disengaged from the secondary pawl abutment 38 of the crank shaft lever 34. The crank shaft is now no longer held in its first position and the geometry of the pawl tooth 17, closed abutment 50 of the rotating claw, and relative positions of the crank axis B and pawl axis C are such that the crank shaft lever 34 swings clockwise about crank axis B from the FIG. 1 position to the FIG. 3 position thereby disengaging the pawl 16 from the rotating claw 14 and allowing the latch to open as the striker exits the mouth 15 of the claw. This clockwise rotation of the crankshaft causes the pawl axis C to move from its first position C1 to its second position C2.

Figure 2:
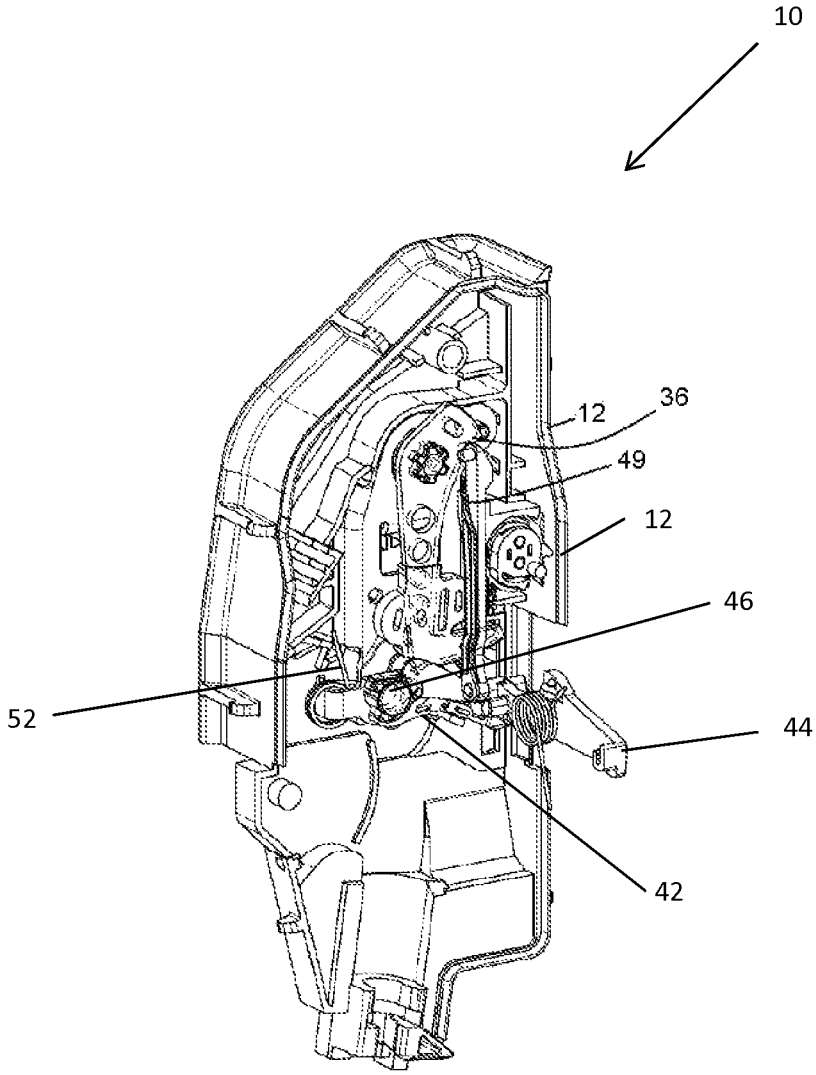
Figure 3:
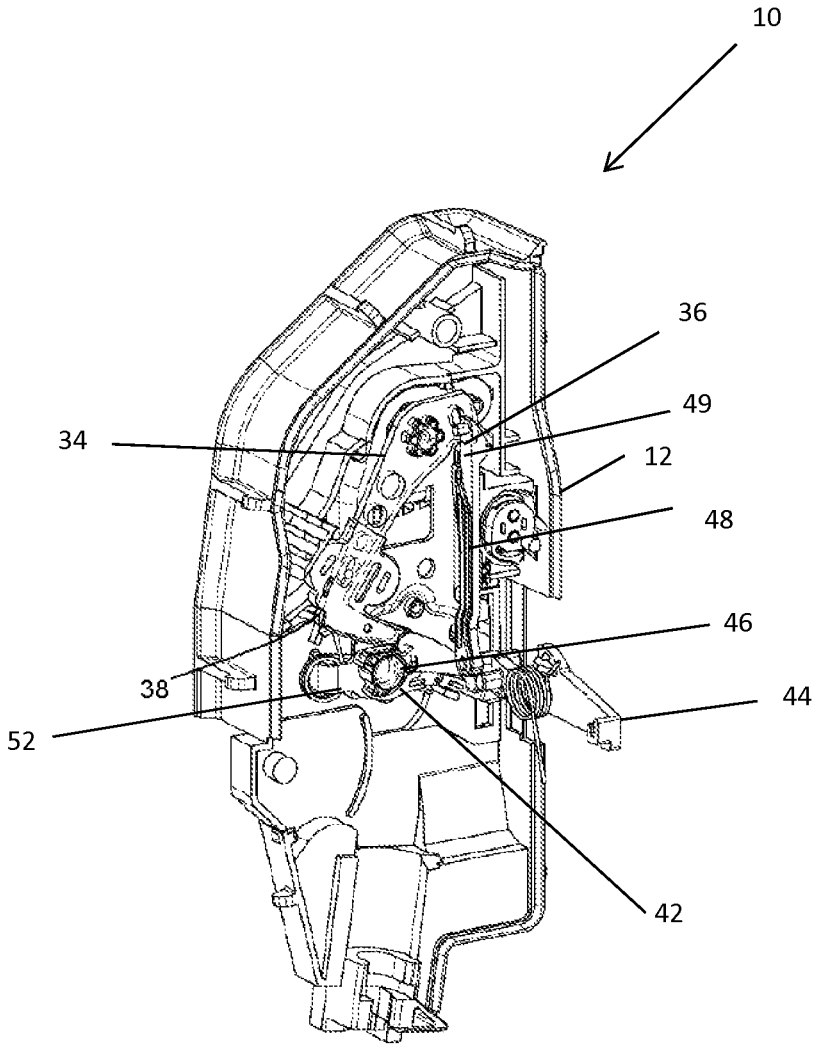

Note as shown in FIG. 3 the release lever 44 is still actuated and hence the reset link 48 is in its non-reset position, i.e. the lower position as shown in FIG. 3. Consideration of FIGS. 1, 2 and 3 show that as the release lever 44 is actuated, the reset link abutment 49 moves away (generally downwardly) from the reset abutment 36 of the crank shaft lever 34.

Figure 4:
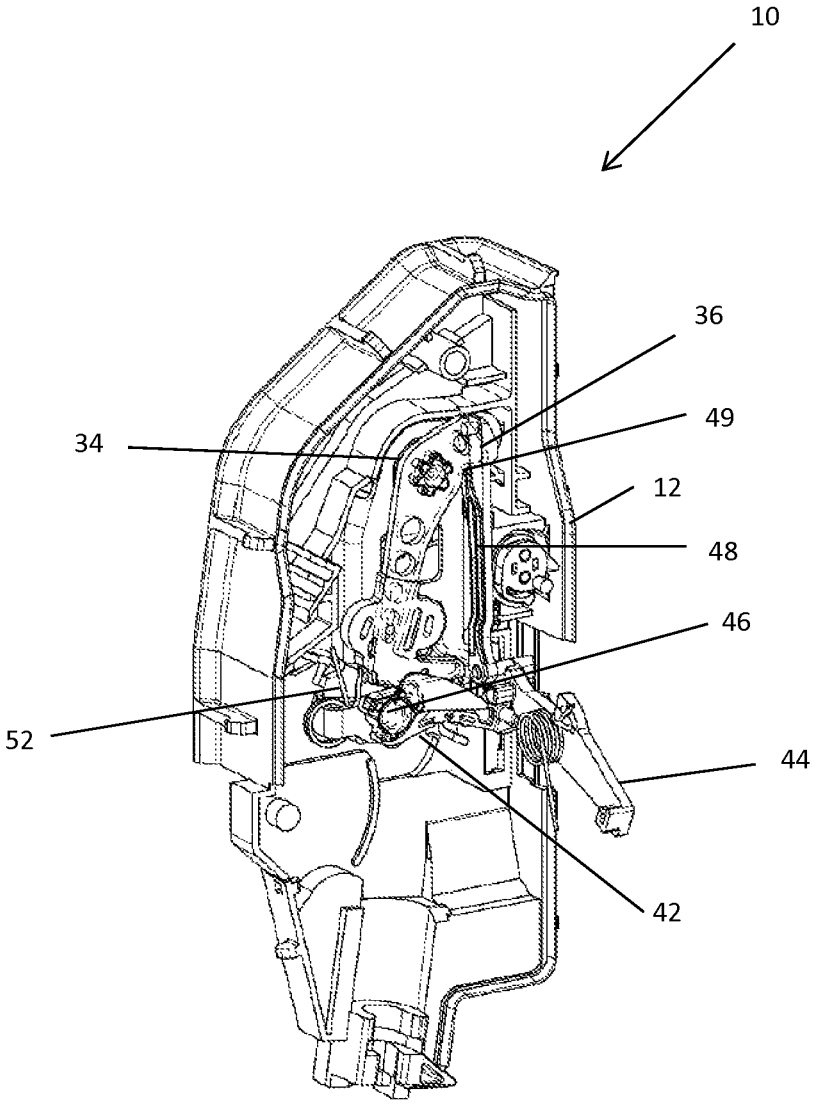
Figure 5:
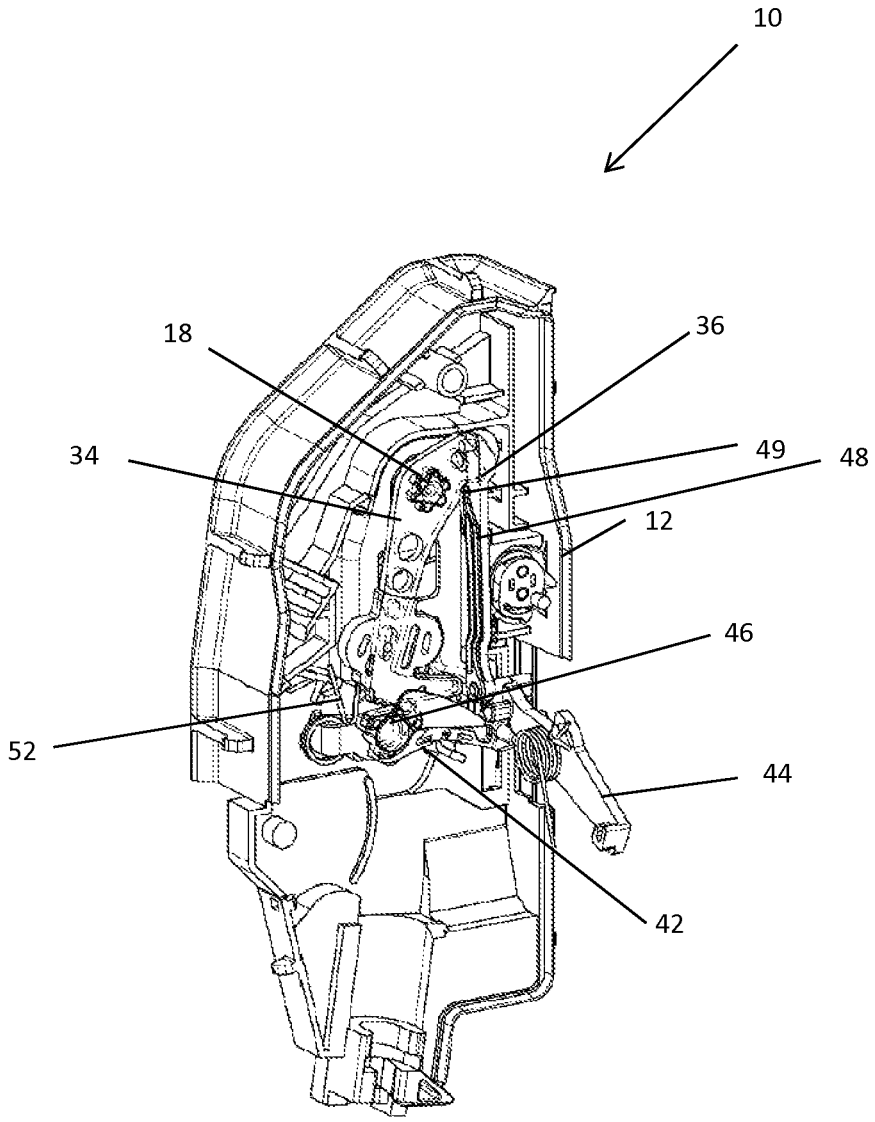
Figure 6:
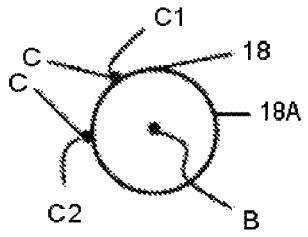
FIG. 6 is an end view of the eccentric arrangement (crank shaft) showing the crank shaft axis B and the first pawl axis position C1 and the second pawl axis position C2.
Figure 7:
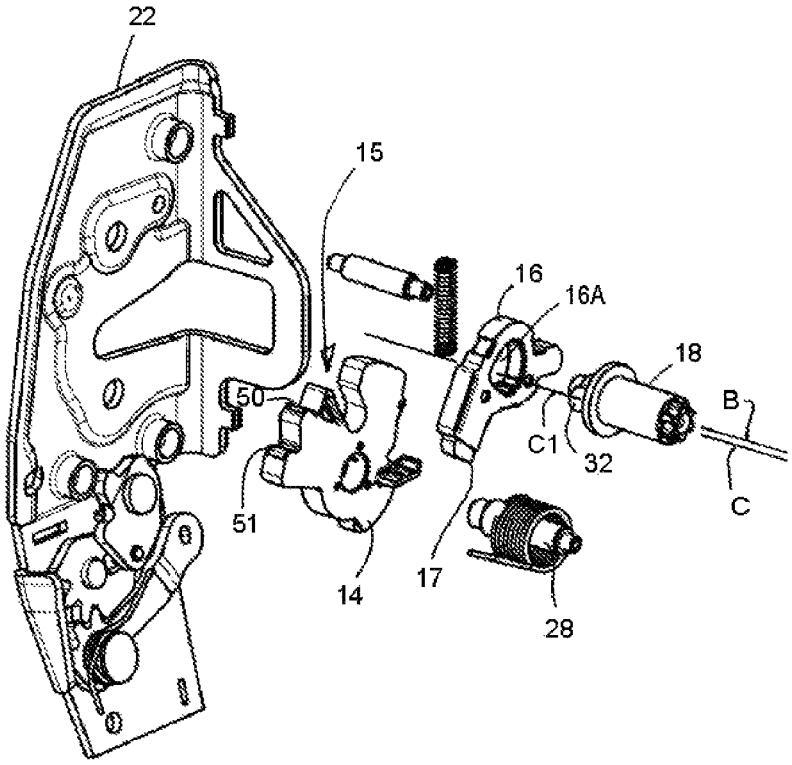
FIGS. 7 and 8 are exploded views of part of the latch assembly of FIG. 1.
Figure 8:
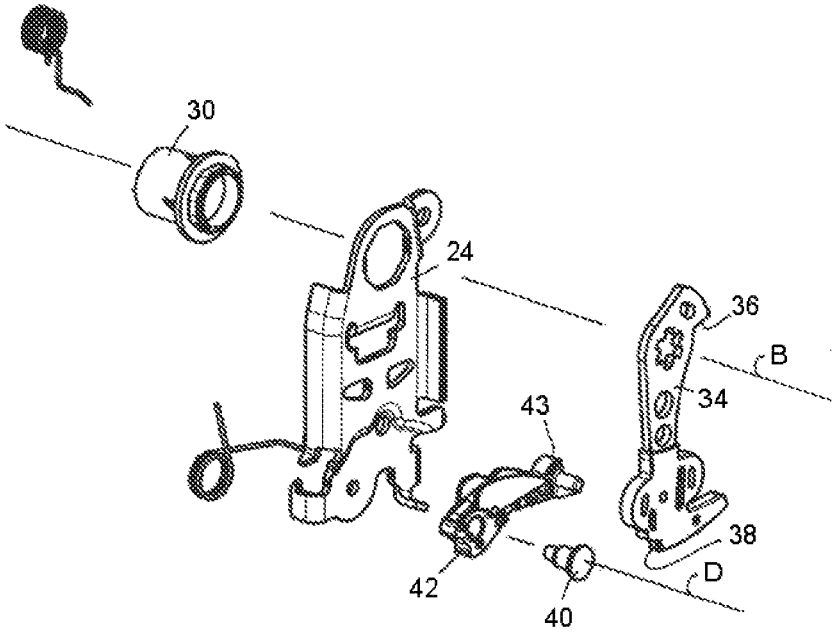

When the release lever 44 is released it returns to its rest position causing the reset link 48 to be lifted (when viewing FIGS. 4 and 5). During release of the release lever 44 the reset link abutment 49 initially engages reset abutment 36 of crank shaft lever 34 and then causes the crank shaft lever 34 to rotate in an anticlockwise direction. FIG. 4 shows the crank shaft lever 34 partially returned to its first position and FIG. 5 shows the crank shaft lever 34 fully returned to its first position with the release lever 44 in its rest position. Once the crank shaft lever 34 is returned to the FIG. 5 position, the spring 52 causes the secondary pawl 42 to return to its retaining position such that secondary pawl tooth 43 faces secondary pawl abutment 38 of crank shaft lever 34. With the crank shaft in its first position the pawl axis will necessarily be in the first pawl axis position C1 and the pawl 16 will be able to hold the claw in the closed position or the first safety position when the pawl tooth 17 engages the closed abutment 50 or the first safety abutment 51 respectively.

Note in particular that resetting of the pawl axis from the second position C2 to the first position C1 is dependent upon the position of the release lever 44. In particular resetting of pawl axis from the second pawl axis position C2 to the first pawl axis position C1 is independent of the position of the rotating claw.

The release lever 44 is connected to an inside door handle and an outside door handle and to a release motor. When the door is manually operated, under normal circumstances, the inside or outside door handle will be pulled, thereby moving the release lever from the rest position to the release position. This movement will move the secondary pawl 42 from its retaining position to its non retaining position and will move the reset link from its reset position to its non-reset position. The pawl axis is then allowed to move from the first position C1 to the second position C2 allowing the pawl to release the claw and for the claw to release the striker. The inside or outside door handle will then be released by the operator which will move the release lever to the rest position and cause the reset link to move from the non-reset position to the reset position thereby rotating the crank shaft and moving the pawl axis from the second position C2 to the first position C1. The spring 52 will cause the secondary pawl to move from its non retaining position to its retaining position.

Subsequent closing of the door will cause the striker to move into the mouth 15 and rotate the claw to the fully closed position whereupon the pawl tooth 17 will engage the closed abutment 50. Alternatively, if the door is not slammed hard enough then the striker may only move the claw 14 to a position whereby the first safety abutment of the claw has passed under the pawl tooth 17 but the closed abutment has not. Under these circumstances the door will be held in the first safety position by engagement between the pawl tooth 17 and the first safety abutment 51.

In the event that the door seals may be frozen then the operation of the door is as follows:

An operator will lift an outside door handle thereby moving the release lever 44 from the rest position to the released position. This in turn moves the reset link from the reset position to the non-reset position and moves the secondary pawl from the retaining position to the non-retaining position. For the purposes of explanation, it is assumed the pawl axis moves from the first pawl axis position C1 to the second pawl axis position C2 and the closed abutment 50 of the claw moves under the pawl tooth 17. However, because of the frozen door seals the first safety abutment 51 does not move under the pawl tooth 17. The driver is unable to open the door and therefore releases the door handle and enters the vehicle via an alternative route. Upon release of the door handle the release lever 44 returns to the rest position and in doing so moves the reset link generally upwards towards its reset position whereupon the crank shaft is rotated to its first position and the pawl axis is returned from the second position C2 to the first position C1. Concurrently the secondary pawl returns to its retaining position wherein the secondary pawl tooth 43 faces the secondary pawl abutment 38 of the crank shaft lever 34.

Under these circumstances the pawl axis is in its first position and the pawl 16 is effective. In particular, as the door seals unfreeze, the door seals will push the door out, but only until such time as the pawl tooth 17 engages the first safety abutment 51. This engagement will prevent further opening of the door.

Clearly different variations of latch are required to be fitted to variants of the same vehicle or car.

Vehicles typically have right hand (RH) and left hand (LH) doors which require right and left hand latches. Certain components of a right hand latch will be opposite handed to the left hand latch, whereas certain other components need not be handed (i.e. can be the same).

Vehicles have front and rear doors with typically rear doors requiring child safety features whereas the front doors do not require any such child safety features. Some vehicles are right hand drive and some vehicles are left hand drive and typically the driver's door will include a key barrel operable by a key, whereas the front passenger door will not.

Where a child safety feature is fitted, this can be a manually operated child safety feature (MCS) or alternatively it can be an electrically operated child safety feature (ECS).

Latches will typically require locking, and certain latches require certain security statuses. Central door locking (CDL) refers to a system of remotely locking the latch, typically by using an electric motor. The latch will be locked, but not superlocked, i.e. with the latch locked, pulling the outside door handle will not open the latch but operating the inside door handle will open the latch. Alternatively, superlocking (SL) latches can be provided wherein in the superlocked condition operating either the outside door handle or the inside door handle will not open the latch.

Some latches can include a power closure feature (PC). Thus, once the door has been closed to the first safety position, the power actuator, typically an electric motor, will then drive the claw from the first safety position to the fully closed position.

Some vehicles include adaptive cruise control systems where the speed of the vehicle varies in cruise control mode dependent upon the proximity of other vehicles. When a traffic jam occurs the adaptive cruise control system can slow the vehicle to a standstill. When the traffic jam clears the adaptive cruise control system will accelerate the vehicle from a standstill. It is important that the driver is still in the vehicle when it accelerates away from its stationary position. Thus, whilst latches traditionally include an ajar switch but indicates that the door has been opened, where adaptive cruise control systems are used an additional ajar switch may be incorporated to ensure that the driver has not exited the vehicle whilst stationary and under adaptive cruise control. This additional ajar switch will be located in the latch.

Table 1 below shows typical variants (in this case 32 variants) of door latches according to the present invention.

TABLE 1

| | Position | | | | Locking | | Drive | | Key | | Child Safety | | ACC+ | Power closure |
|---|---|---|---|---|---|---|---|---|---|---|---|---|---|---|
| Variant | Front | Rear | RH | LH | CDL | SL | RHD | LHD | Key | No Key | Manual | Electric | Yes | Yes |
| 1 | X | | X | | | X | X | | X | | | | | |
| 2 | X | | | X | | X | | X | X | | | | | |
| 3 | X | | X | | | X | X | | X | | | | X | |
| 4 | X | | | X | | X | | X | X | | | | X | |
| 5 | X | | X | | | X | | X | | X | | | | |
| 6 | X | | | X | | X | X | | | X | | | | |
| 7 | | X | X | | | X | | | | | X | | | |
| 8 | | X | | X | | X | | | | | X | | | |
| 9 | | X | X | | | X | | | | | | X | | |
| 10 | | X | | X | | X | | | | | | X | | |
| 11 | X | | X | | | X | X | | X | | | | X | X |
| 12 | X | | | X | | X | | X | X | | | | X | X |
| 13 | X | | X | | | X | | X | | X | | | X | X |
| 14 | X | | | X | | X | X | | | X | | | X | X |
| 15 | | X | X | | | X | | | | | | X | | X |
| 16 | | X | | X | | X | | | | | | X | | X |
| 17 | X | | X | | X | | | X | | X | | | | |

TABLE 1-continued

| | Position | | | | Locking | | Drive | | Key | | Child Safety | | ACC+ | Power closure |
|---|---|---|---|---|---|---|---|---|---|---|---|---|---|---|
| Variant | Front | Rear | RH | LH | CDL | SL | RHD | LHD | Key | No Key | Manual | Electric | Yes | Yes |
| 18 | X | | | X | X | | | X | X | | | | | |
| 19 | X | | X | | X | | X | | X | | | | X | |
| 20 | X | | | X | X | | | X | X | | | | X | |
| 21 | X | | X | | X | | | X | | X | | | | |
| 22 | X | | | X | X | | X | | | X | | | | |
| 23 | | X | X | | X | | | | | | X | | | |
| 24 | | X | | X | X | | | | | | X | | | |
| 25 | | X | X | | X | | | | | | | X | | |
| 26 | | X | | X | X | | | | | | | X | | |
| 27 | X | | X | | X | | | X | | X | | | X | X |
| 28 | X | | | X | X | | | X | X | | | | X | X |
| 29 | X | | X | | X | | | X | | X | | | | X |
| 30 | X | | | X | X | | X | | | X | | | | X |
| 31 | | X | X | | X | | | | | | | X | | X |
| 32 | | X | | X | X | | | | | | | X | | X |

With reference to FIGS. 9 to 18 an alternative numbering system has been used. A list of these numbers together with the description of the component is shown below in table 2. The bracketed terms in the description below refer to the alternative name for this component used above.

Figure 9:
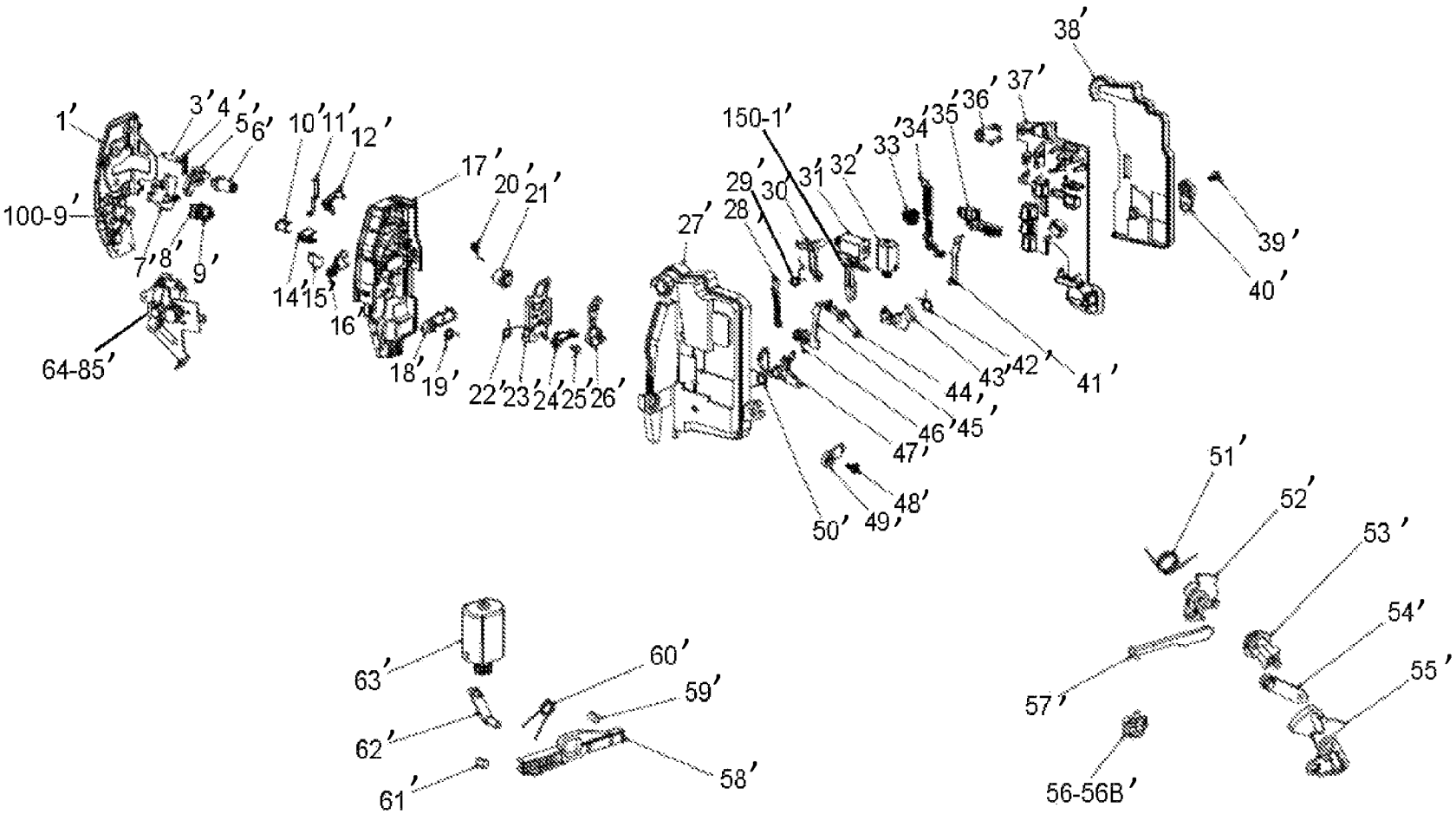
FIG. 9 is an exploded view of the latch assembly of FIG. 1 including additional components that make up certain variants of the latch.

FIG. 9 shows the modular nature of the latch. Most of the components shown in FIGS. 10, 11, 12, 13, 14 and 15 will be present in each latch variant. However, certain components shown in these figures will not be present in all variants, for example the SL motor assembly 31' is only fitted to latches requiring superlocking and the key nut 36' is only fitted to latches having an associated key.

Figure 16:
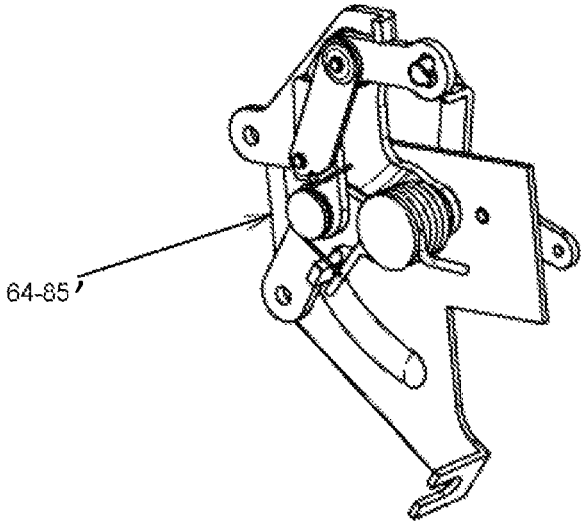
FIG. 16 is an enlarged view of part of FIG. 9 showing the cinching clutch assembly.
Figure 17:
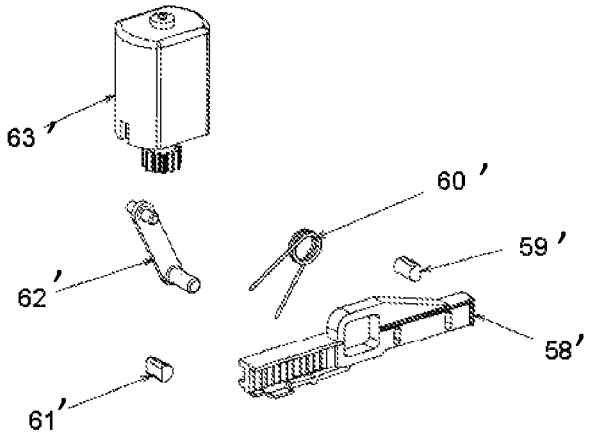
FIG. 17 is an enlarged view of part of FIG. 9 showing the electric child safety components.
Figure 18:
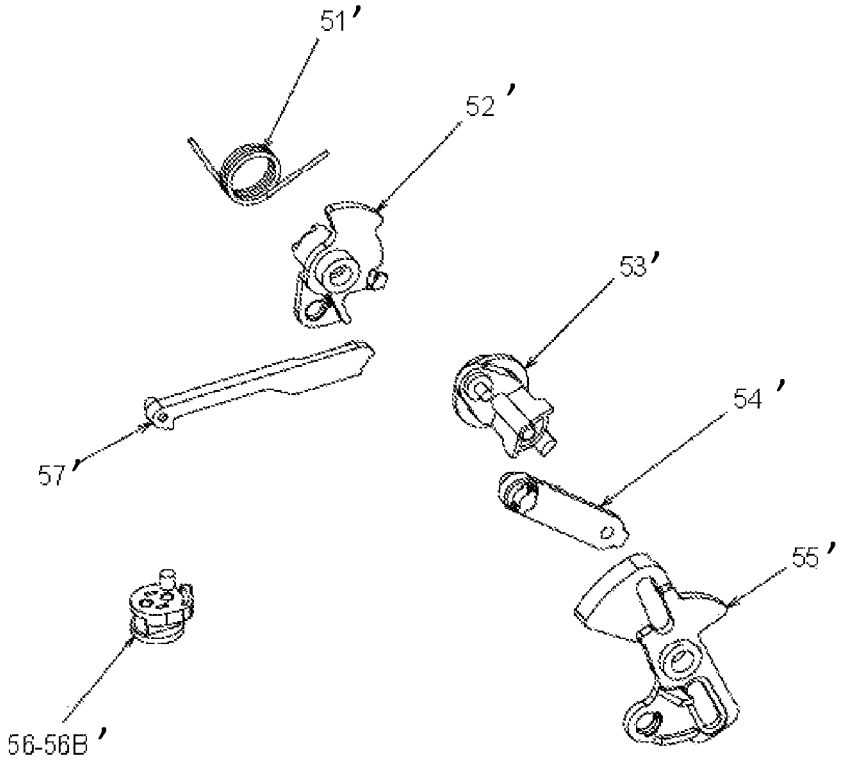
FIG. 18 is an enlarged view of part of FIG. 9 showing the manual child safety components.

FIG. 16 shows the power closure cinching clutch assembly and this is only fitted to components having power closure. FIG. 17 shows the electric child safety components and this will only be fitted to latches requiring electric child safety. FIG. 18 shows the manual child safety components and this will only be fitted to latches requiring manual child safety.

TABLE 2

Figure 10:
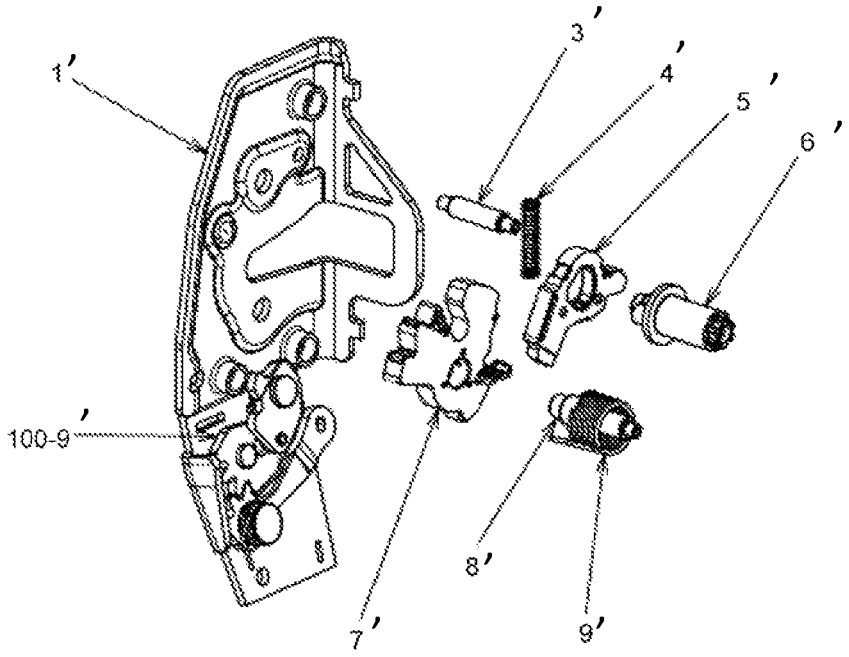
FIGS. 10 and 11 are an enlarged view of part of FIG. 9 showing the retention assembly and housing assembly.
Figure 11:
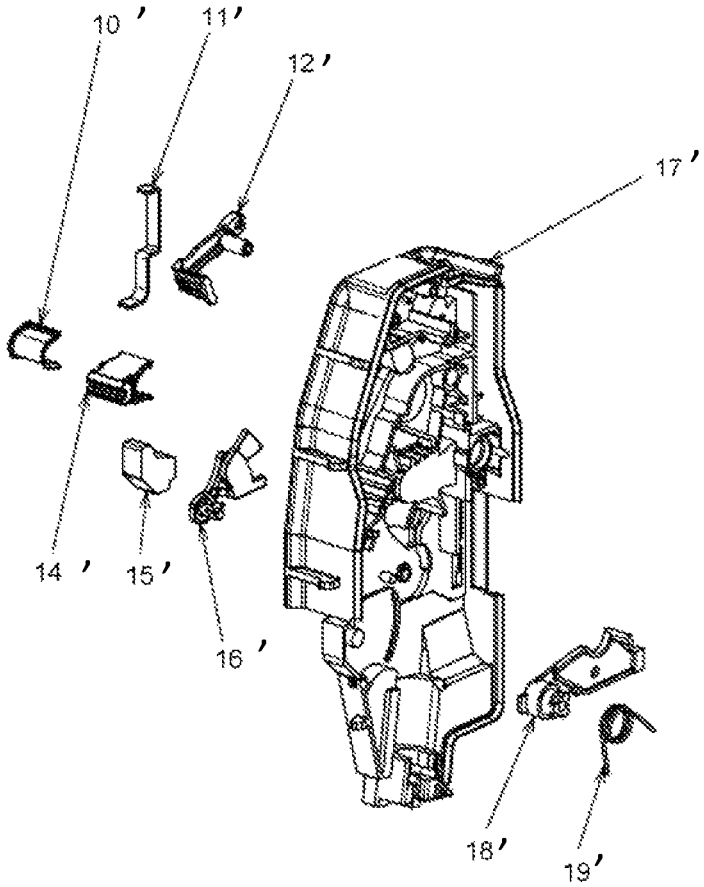
Figure 12:
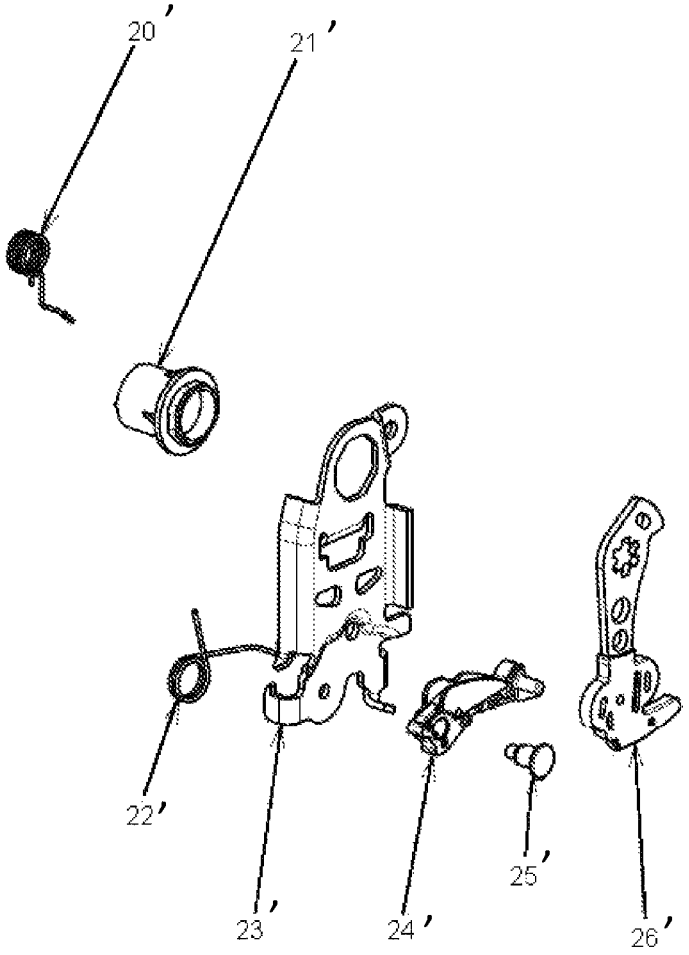
FIG. 12 is an enlarged view of part of FIG. 9 showing the backplate assembly.
Figure 13:
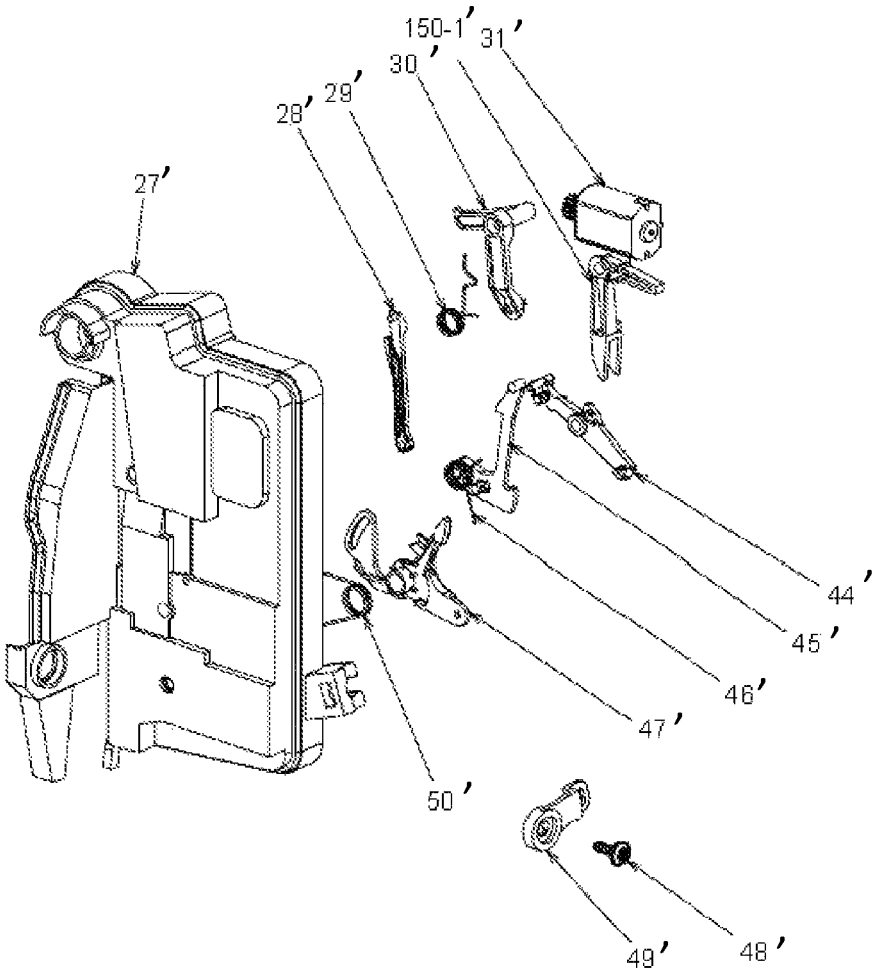
FIGS. 13, 14 and 15 are enlarged views of FIG. 9 showing the actuator assembly.
Figure 14:
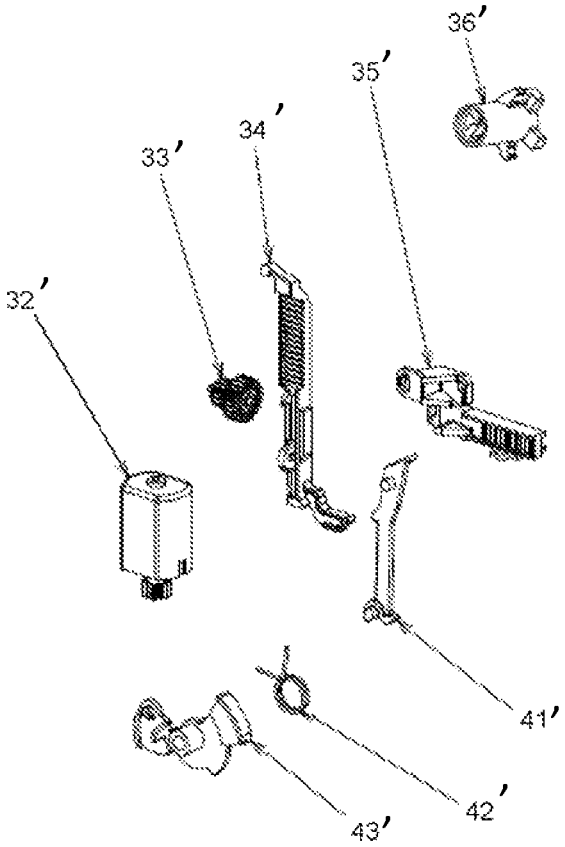
Figure 15:
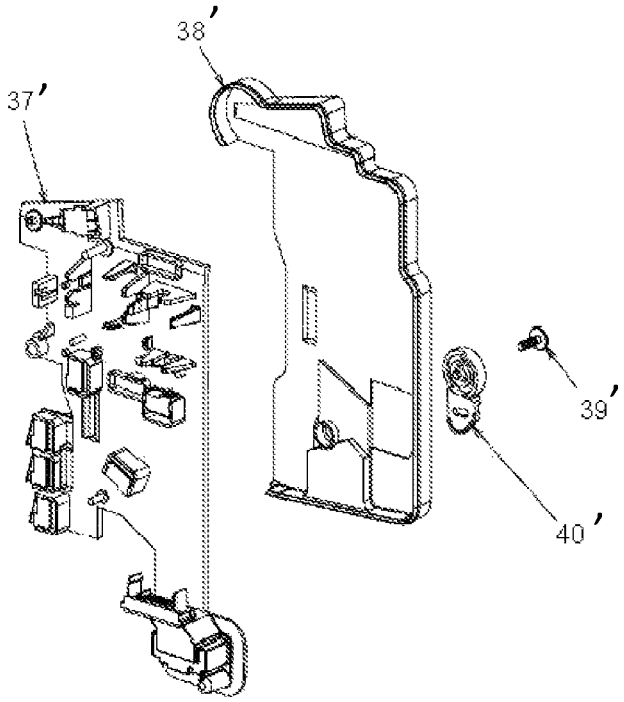

| FIGS. 9 to 11 Drawing Item No. | Description |
|---|---|
| 1' | Retention Plate - Cinching RH |
| 3' | PAWL FULCRUM |
| 5' | PAWL |
| 6' | ECCENTRIC BLANK (CRANKSHAFT) |
| 7' | CLAW OVERMOULDED ASSY RH (LATCH BOLT) |
| 8' | CLAW PIVOT (CLAW PIVOT PIN) |
| 9' | CLAW SPRING |
| 10' | STRIKER GUIDE |
| 11' | PAWL DRIVER - CINCHING |
| 12' | PAWL SWITCH LEVER RH |
| 14' | STRIKER BUFFER |
| 15' | CLAW BUFFER |
| 16' | AJAR Switch Lever RH |
| 17' | HOUSING RH Key CINCHING |
| 18' | OUTSIDE HANDLE LEVER RH |
| 19' | OS Handle Spring RH |
| 20' | Anti-re-latch spring RH |
| 21' | ECCENTRIC BEARING (CRANKSHAFT BUSH) |
| 22' | LOW ENERGY PAWL SPRING RH |
| 23' | BACKPLATE RH |
| 24' | LOW ENERGY PAWL OVERMOULDED RH (SECONDARY PAWL) |
| 25' | LOW ENERGY PAWL PIVOT (PIN) |
| 26' | OVERMOULDED INNER LEVER (CRANKSHAFT LEVER) |
| 27' | ACTUATOR HOUSING KEY CINCHING RH |
| 28' | RESET LINK RH |

TABLE 2-continued

| FIGS. 9 to 11 Drawing Item No. | Description |
|---|---|
| 29' | CDL RACK SPRING |
| 30' | KEY SUPERLOCK LINK RH |
| 31' | SL MOTOR ASSY |
| 32' | CDL MOTOR ASSY |
| 33' | cdl RACK PINION |
| 34' | CDL RACK RH KEY |
| 35' | SL RACK RH |
| 36' | KEY NUT |
| 37' | Electrical Carrier Assy RH Front SL PC with Key |
| 38' | ACTUATOR COVER KEY RH |
| 39' | Screw - handle lever |
| 40' | INSIDE LEVER NEW RH |
| 41' | INSIDE HANDLE CLUTCH LINK Front RH |
| 42' | INSIDE HANDLE SPRING RH |
| 43' | INSIDE HANDLE LEVER RH |
| 44' | RELEASE LEVER RH |
| 45' | CLUTCH LINK OUTSIDE HANDLE RH |
| 46' | RELEASE LEVER SPRING RH |
| 47' | CLUTCH LEVER RH |
| 48' | SCREW |
| 49' | OUTSIDE HANDLE CABLE LEVER RH |
| 50' | OUTSIDE HANDLE ENGAGING SPRING RH |
| 51' | MCS LINK SPRING |
| 52' | INSIDE HANDLE CABLE LEVER |
| 53' | MANUAL CHILD LOCK NUT |
| 54' | mcs LINK |
| 55' | INSIDE HANDLE DRIVE LEVER |
| 56' | EMERGENCY LOCK NUT |
| 56B' | EMERGENCY LOCK LEVER |
| 57' | INSIDE HANDLE OVERRIDE LINK |
| 58' | Electrical child lock rack |
| 60' | Electrical child lock link spring |
| 61' | Buffer - ecs rack |
| 62' | ELECTRICAL CHILD LOCK RACK |
| 63' | SL MOTOR ASSY |
| 64' | Latch Lever |
| 65' | Actuator Lever |
| 66' | Drive Lever |
| 67' | Rivet Drive Lever |
| 68' | Drive Pin |
| 69' | Pawl |
| 70' | Release Lever |
| 71' | Rivet Latch Lever |
| 72' | Rivet Pawl |
| 73' | Base Plate |
| 74' | Rivet Release Lever |
| 75' | Retainer |
| 76' | Spring Drive Lever |
| 77' | Spring Actuator Lever |

TABLE 2-continued

| FIGS. 9 to 11 Drawing Item No. | Description |
|---|---|
| 78' | Connect Lever |
| 79' | Spring Release |
| 80' | Cable - latch lever |
| 81' | Cable Release lever |
| 82' | Connecting plate |
| 83' | Switch & connector |
| 84' | Cover |
| 85' | Screw |
| 100' | HOUSING Assy Cinching with Key RH |
| 100' | PC Lever RH |
| 101' | PC Lever Rivet |
| 102' | PC Lever Spacer |
| 103' | Idler Gear Drive Pin |
| 104' | Idler Gear |
| 105' | Rivet Idler Gear |
| 106' | Cable Lever RH |
| 107' | Cable Lever Rivet |
| 108' | Buffer |
| 109' | Cable Lever Return Spring RH |
| 150' | INTERLOCK LEVER RH |
| 151' | INTERLOCK SPRING RH |
| part of 37 | MICRO SWITCH BLADE RH |
| part of 37 | MICRO SWITCH BLADE LH |
| part of 37 | Electrical Carrier RH Front SL PC with Key |
| part of 37 | Connector RH |
| part of 37 | MICRO SWITCH RH |
| part of 37 | MICRO SWITCH LH |
| part of 37 | Resistor |
| part of 37 | Potting |
| part of 37 | Pawl Switch RH |
| part of 37 | Centre Off |

What is claimed is:

1. A latch assembly having a chassis;

a latch bolt, movably mounted on the chassis and having a closed position for retaining a striker and an open position for releasing the striker;

a pawl having an engaged position at which the pawl is engaged with the latch bolt to hold the latch bolt in the closed position and a disengaged position at which the pawl is disengaged from the latch bolt thereby allowing the latch bolt to move to the open position;

a crank shaft having a lug movably received within an opening of the pawl to define a pawl axis about which the pawl rotates, the crank shaft being rotatable about a crank shaft axis;

wherein the pawl moves from the engaged position to the disengaged position as the crank shaft rotates about the crank shaft axis to move the pawl axis from a first pawl axis position to a second pawl axis position;

a secondary pawl movable between a retaining position wherein the pawl axis is held in the first pawl axis position and a non-retaining position wherein the pawl axis is allowed to move to the second pawl axis position, the second pawl axis position being different from the first pawl axis position;

a release lever operable to move the secondary pawl from the retaining position to the non-retaining position when the release lever is moved from a rest position to a released position;

wherein movement of the release lever from the released position to the rest position causes the pawl axis to move from the second pawl axis position to the first pawl axis position;

wherein movement of the pawl axis from the second pawl axis position to the first pawl axis position is not dependent upon the position of the latch bolt; and wherein a crank shaft lever is fixedly secured to the crank shaft and the release lever is operably coupled to crank shaft lever via a reset link operably coupled to the release lever.

2. The latch assembly as in claim 1, wherein the reset link is rotatably mounted to a pin of the release lever.

3. The latch assembly as in claim 1, further comprising an inside door handle operably connected to the release lever.

4. The latch assembly as in claim 3, further comprising an outside door handle operably connected to the release lever.

5. The latch assembly as in claim 1, further comprising a power operated actuator operably connected to the release lever.

6. The latch assembly as in claim 1, wherein the pawl moves from the engaged position to the disengaged position as the crank shaft rotates in one of a clockwise and an anticlockwise direction and wherein when the pawl is in the engaged position a force applied to the pawl by the latch bolt creates a turning moment on the crank shaft in said one of clockwise and anticlockwise direction and the crank shaft is prevented from rotating in said one of a clockwise and anticlockwise direction by the secondary pawl, the secondary pawl being operably coupled to the release lever via an abutment of the release lever which engages the secondary pawl as the release lever is moved from a rest position to a release position.

7. The latch assembly as in claim 6, wherein the secondary pawl prevents rotation of the crank shaft by engaging an abutment of the crank shaft lever when the secondary pawl is in the retaining position and wherein the abutment of the crank shaft lever is not engaged by the secondary pawl when the secondary pawl is in the non-retaining position.

8. The latch assembly as defined in claim 7, wherein the lug of the crank shaft and the opening of the pawl are configured such that rotation of the crank shaft about the crank shaft axis causes the pawl axis to move from between the first pawl axis position and the second pawl axis position.

9. The latch assembly as claim 1, wherein the latch bolt further includes a first safety position for retaining the striker, the pawl having a first safety engaged position at which the pawl is engaged with the latch bolt to hold the latch bolt in the first safety position.

10. The latch assembly as in claim 1, wherein the first pawl axis position and the second pawl axis position are parallel to but spaced from the crank shaft axis.

11. The latch assembly as in claim 1, wherein the release lever rotates about an axis orthogonal to the crank shaft axis.

12. The latch assembly as in claim 11, wherein movement of the release lever from the released position to the rest position causes the reset link to directly contact the crank shaft lever and rotate the crank shaft via movement of the crank shaft lever and wherein rotation of the crank shaft via the crank shaft lever causes the crank shaft axis to move between the first pawl axis position and the second pawl axis position.

13. The latch assembly as in claim 12, wherein the secondary pawl moves between the retaining position and the non-retaining position by rotating about an axis D, wherein axis D is parallel to the crank shaft axis.

14. The latch assembly as in claim 11, wherein the reset link is configured to engage and disengage an abutment surface of the crank shaft lever as the reset link is moved by the release lever.

15. The latch assembly as in claim 1, wherein rotation of the lug in the opening of the pawl causes the pawl axis to move between the first pawl axis position and the second pawl axis position.

16. The latch assembly as in claim 1, wherein the reset link is rotatably mounted to a pin of the release lever.

17. The latch assembly as in claim 16, wherein the pawl rotates about the lug.

18. The latch assembly as in claim 16, wherein movement of the pawl axis from the second pawl axis position to the first pawl axis position is dependent upon movement of the release lever from the released position to the rest position.

19. The latch assembly as in claim 18, wherein movement of the secondary pawl from the retaining position is dependent upon movement of the release lever from the rest position to the released position.

20. The latch assembly as in claim 19, wherein the secondary pawl is operably coupled to the release lever via an abutment of the release lever which engages the secondary pawl as the release lever is moved from a rest position to a release position and wherein the release lever rotates about an axis orthogonal to the crank shaft axis.

* * * * *